US007032342B2

(12) United States Patent
Pikielny

(10) Patent No.: US 7,032,342 B2
(45) Date of Patent: Apr. 25, 2006

(54) MAGAZINE LIGHT

(76) Inventor: Dov Pikielny, 7 Dov Hoz St., Herzliya (IL) 46581

( * ) Notice: Subject to any disclaimer, the term of this patent is extended or adjusted under 35 U.S.C. 154(b) by 52 days.

(21) Appl. No.: 10/801,690

(22) Filed: Mar. 17, 2004

(65) Prior Publication Data

US 2005/0223614 A1 Oct. 13, 2005

(51) Int. Cl.
*F41G 1/35* (2006.01)

(52) U.S. Cl. ..... 42/146; 42/117; 362/110

(58) Field of Classification Search ..... 42/1.01, 42/1.02, 1.03, 113, 114–117, 142, 146, 132; 362/110–114
See application file for complete search history.

(56) References Cited

U.S. PATENT DOCUMENTS 4,936,037 A * 6/1990 Holcomb et al. ..... 42/106
5,052,138 A * 10/1991 Crain ..... 42/1.02
5,177,309 A * 1/1993 Willoughby et al. ..... 42/115
5,406,730 A * 4/1995 Sayre ..... 42/1.02
5,435,091 A * 7/1995 Toole et al. ..... 42/117
5,557,872 A 9/1996 Langner et al.
5,592,769 A 1/1997 Villani et al.
5,642,581 A * 7/1997 Herold et al. ..... 42/1.02
5,706,600 A * 1/1998 Toole et al. ..... 42/115
6,023,875 A * 2/2000 Fell et al. ..... 42/146
6,226,913 B1 * 5/2001 Haimovich et al. ..... 42/1.01
6,363,647 B1 * 4/2002 Kaminski ..... 42/70.11
6,385,894 B1 * 5/2002 Podvin ..... 42/146

* cited by examiner

*Primary Examiner*—Stephen M. Johnson
(74) *Attorney, Agent, or Firm*—Dekel Patent Ltd.; David Klein

(57) ABSTRACT

A weapons magazine including a magazine body adapted for storing rounds therein, a biasing device for urging rounds out of the magazine body, a power source disposed in a portion of the magazine body, and a light mounted on a surface of the magazine body in electrical communication with the power source.

11 Claims, 2 Drawing Sheets

FIG. 1

MAGAZINE LIGHT

FIELD OF THE INVENTION

The present invention relates generally to lights for weapons, and particularly to a light in a magazine for a weapon, such as but not limited to, a handgun magazine, a long gun magazine or assault rifle magazine.

BACKGROUND OF THE INVENTION

Most handguns and many rifles employ a cartridge magazine for holding several cartridges and feeding those cartridges to the firing chamber of the handgun or rifle in an automatic or semi-automatic manner. When used with handguns, the conventional cartridge magazines fit into the frame of the handgrip of the handgun, located behind the trigger, or in front of the trigger depending on the weapon type.

Firearms are increasingly being provided with lights. For example, many handguns are provided with a light mounting rail formed on the pistol frame, such as on the underside or top side or on either side of the barrel. Such a mounting rail is often referred to in the art as a "light rail". The light rail has been used for mounting whitelights, infrared and laser illuminating devices and telescopic sights, for example.

Lights have also been mounted on or near the magazine. For example, US Published Patent Application U.S. 2002172034 describes a light source guide for attachment to a bottom of a firearm magazine with rails and other attachments for mounting thereon a flashlight.

U.S. Pat. No. 6,023,875 describe an illumination source and mounting system to be detachably secured to a family of firearms including pistols, revolvers and long guns. A "mount-to-magazine interface" aligns the light beam to provide illumination at a fixed range impact point.

U.S. Pat. No. 5,816,683 to Christiansen describes a flashlight adapter for a handgun having a base retainer receivable into the interior of a magazine through a distal end thereof. A spring biases the base retainer toward the distal end. The magazine has a flange about the distal end of the magazine. A magazine base is removably engaged on the flange and is secured in its assembled position by protuberances extending from the base retainer being received in apertures in the magazine base. The magazine base has a channel therein for receiving a light holder for holding a flashlight therein. The light holder is selectively received within the magazine base.

U.S. Pat. No. 5,557,872 to Langner describes a power supply for a laser sighting device, or other accessory on a firearm, which is located in the bottom of the cartridge magazine separate from the laser sighting device itself, and which has an on/off switch location automatically engaged by the hand of the user when the firearm is in use.

SUMMARY OF THE INVENTION

The present invention seeks to provide a weapons magazine with a light disposed therein, as is described in detail further hereinbelow. The light may be used to locate the magazine or the firearm in the dark, for example. Other non-limiting uses include using the magazine light as a backup flash light, or to inform of an emergency situation when the light is in a blinking mode or to locate an individual holding the firearm. Unlike the prior art, the light is not necessarily directed in the aiming direction of the weapon.

There is thus provided in accordance with an embodiment of the present invention a weapons magazine including a magazine body adapted for storing rounds therein, a biasing device for urging rounds out of the magazine body, a power source disposed in a portion of the magazine body, and a light mounted on a surface of the magazine body in electrical communication with the power source.

The weapons magazine can include one or more of the following features. For example, the magazine body may be insertable in a magazine well of a weapon having a firing axis, and the light is arranged not to point in a direction parallel to the firing axis of the weapon. The light may be mounted on a floor plate of the magazine body. The power source may be disposed between the biasing device and a floor plate of the magazine body. A switch may be in electrical communication with the light and the power source.

The light may be any kind of light source, such as but not limited to, an incandescent light bulb, a light emitting diode (LED), and/or a laser light device.

There is also provided in accordance with an embodiment of the present invention a retrofit kit for a weapons magazine including a floor plate securable to the magazine, a power source disposable in a portion of the magazine adjacent the floor plate, and a light mounted on the floor plate electrically connectable to the power source.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
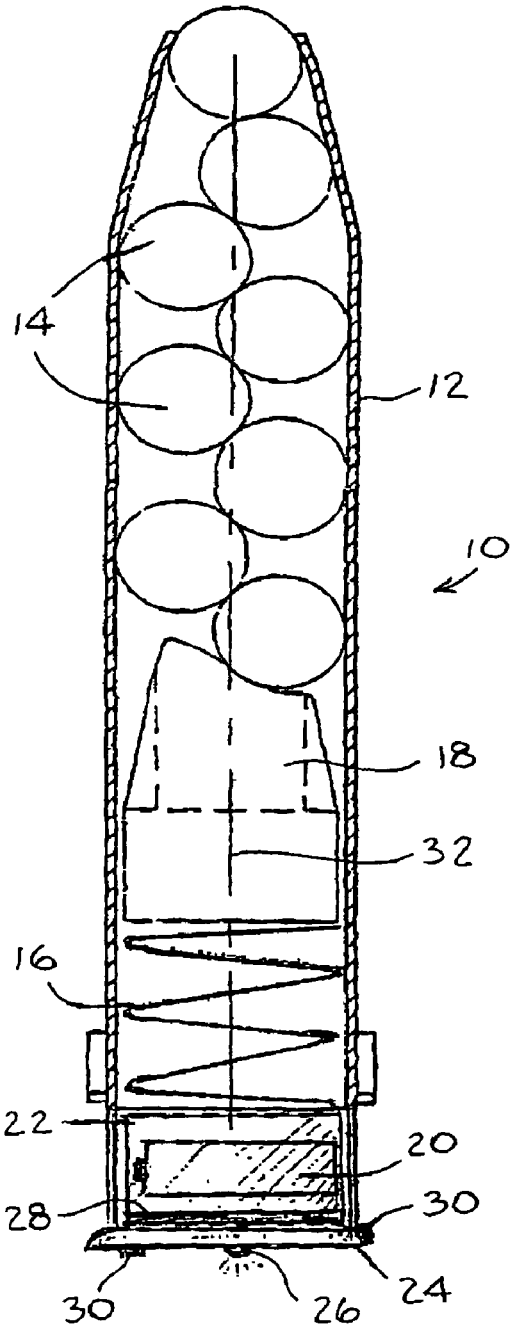
FIG. 1 is a simplified, partially cutaway, partially sectional illustration of a weapons magazine with a light, constructed and operative in accordance with an embodiment of the present invention.
Figure 2:
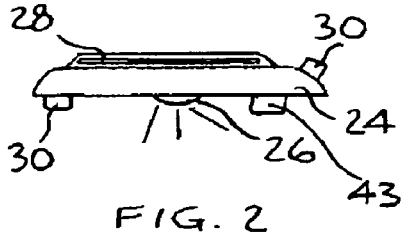
FIG. 2 is a simplified illustration of a bottom portion of the magazine of FIG. 1.

Reference is now made to FIGS. 1 and 2, which illustrate a weapons magazine 10, constructed and operative in accordance with an embodiment of the present invention.

Figure 3:
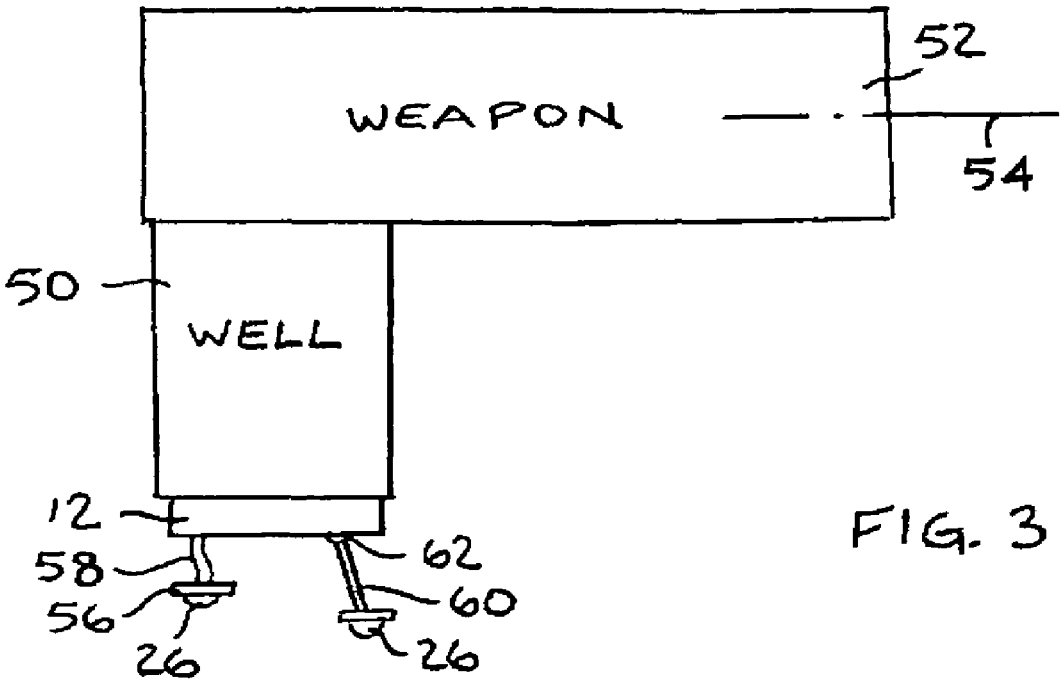
FIG. 3 is a simplified illustration of the magazine of FIG. 1 inserted in a weapon.

The weapons magazine 10 may include a magazine body 12 adapted for storing any number of rounds 14 therein. A biasing device 16, such as a coil spring that cooperates with a pusher element 18, may be provided for urging the rounds 14 out of the magazine body 12, as is well known in the art. The magazine body 12 is adapted to be inserted in a magazine well 50 of a weapon 52 (FIG. 3), such as but not limited to, a handgun, having a firing axis 54 (FIG. 3).

A power source 20, such as a battery (e.g., a rechargeable battery or any other rechargeable power source), may be disposed in a portion of the magazine body 12. For example, in accordance with a non-limiting embodiment of the present invention, the power source 20 is mounted in a housing 22 disposed between the biasing device 16 and a floor plate 24 of the magazine body 12.

A light 26 may be mounted on a surface of the magazine body 12 in electrical communication with the power source 20, such as through circuitry 28 (e.g., hard wires or printed circuit board). In the illustrated embodiment, the light 26 may be mounted on the outside surface of the floor plate 24. The light 26 may be any kind of light source, such as but not limited to, an incandescent light bulb, a light emitting diode (LED), a laser light device, and/or an invisible light source (e.g., visible with night vision equipment only). A switch 30 may be in electrical communication with light 26, circuitry 28 and power source 20. The switch 30 may be placed at any convenient location, such as but not limited to, on the side of the magazine body 12 or floor plate 24, or on the underside of the floor plate 24. The switch can be operated mechanically, electronically or by remote control (or any other type of switch) to activate the light 26.

In accordance with a non-limiting embodiment of the present invention, and as shown in FIG. 2, an RF (radio frequency) component 43, such as an RF transceiver (that is, transmitter and/or receiver) may be mounted on a surface of the magazine body 12, such as on the floor plate 24. The RF component 43 may be in electrical communication with light 26 and may be used as a remotely-activated switch to turn on or off the light 26. In a transmit mode of operation, RF component 43 may emit signals used for locating the magazine 10, the weapon and/or the holder of the magazine or weapon.

Unlike the prior art, the light 26 is not necessarily directed in the aiming direction of the weapon. In accordance with a non-limiting embodiment of the present invention, the light 26 is arranged to point in the direction of a longitudinal axis 32 of the magazine body 12, which is not parallel to the firing axis of 54 of the weapon 52 (FIG. 3). Additionally or alternatively, the light 26 may be flexibly mounted (e.g., as on a flexible fiber optic cable, or on a plate 56 mounted to the rest of the magazine body 12 with a flexible cable or cord 58 and the like), or pivotally mounted (e.g., as on an arm 60 pivotally mounted to the rest of the magazine body 12 with a pinned joint or bearing 62), so that the light 26 may be pointed in any desired direction (FIG. 3).

The weapons magazine 10 may be manufactured and supplied by a magazine manufacturer. Additionally or alternatively, the assembly of the floor plate 24, light 26, power source 20 (and possibly housing 22, circuitry 28 and switch 30) may be supplied as a retrofit kit for a weapons magazine. The kit may be suitable for any kind of weapons magazine, both for low and high capacity magazines.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A weapons magazine comprising:

a magazine body adapted for storing rounds therein;

a biasing device for urging rounds out of the magazine body;

a power source disposed in a portion of said magazine body; and a light mounted underneath an underside of a floor plate of said magazine body in electrical communication with said power source.

2. The weapons magazine according to claim 1, wherein said power source is disposed between the biasing device and said floor plate of said magazine body.

3. The weapons magazine according to claim 1, further comprising a switch in electrical communication with said light and said power source.

4. The weapons magazine according to claim 1, wherein said light comprises an incandescent light bulb.

5. The weapons magazine according to claim 1, wherein said light comprises a light emitting diode (LED).

6. The weapons magazine according to claim 1, wherein said light comprises a laser light device.

7. The weapons magazine according to claim 1, further comprising an RF component mounted on a surface of said magazine body.

8. The weapons magazine according to claim 7, wherein said RF component is adapted to electrically switch said light.

9. The weapons magazine according to claim 7, wherein said RF component comprises an RF transceiver operative to emit signals.

10. The weapons magazine according to claim 1, wherein said light is flexibly mounted to said floor plate.

11. The weapons magazine according to claim 1, wherein said light is pivotally mounted to said floor plate.

* * * * *